US006067678A

United States Patent [19]

Trevino

[11] Patent Number: 6,067,678

[45] Date of Patent: May 30, 2000

[54] PATIENT SUPPORT APPARATUS

[76] Inventor: John Trevino, 129 Acacia Ave., Biloxi, Miss. 39530

[21] Appl. No.: 09/030,683

[22] Filed: Feb. 25, 1998

Related U.S. Application Data

[63] Continuation-in-part of application No. 08/779,927, Jan. 6, 1997, Pat. No. 5,742,963.

[51] Int. Cl.[7] ..... A61G 1/00

[52] U.S. Cl. ..... 5/628; 5/731; 5/740; 5/732; 5/733

[58] Field of Search ..... 5/625, 626, 627, 5/628, 694, 701, 728, 731, 732, 733, 734, 735, 740

[56] References Cited

U.S. PATENT DOCUMENTS

| | | | |
|---|---|---|---|
| 3,110,042 | 11/1963 | Slemmons | 5/345 |
| 3,156,500 | 11/1964 | Kerr | 297/391 |
| 4,024,861 | 5/1977 | Vincent | 5/625 |
| 4,186,453 | 2/1980 | Burns et al. | 5/628 |
| 4,794,657 | 1/1989 | Avery | 5/431 |
| 4,802,249 | 2/1989 | Bills | 5/420 |
| 4,805,603 | 2/1989 | Cumberland | 128/75 |
| 4,893,367 | 1/1990 | Heimreid et al. | 5/431 |
| 4,907,308 | 3/1990 | Leininger et al. | 5/455 |
| 4,918,774 | 4/1990 | Popitz | 5/441 |
| 5,034,594 | 7/1991 | Beezhold et al. | 219/533 |
| 5,121,756 | 6/1992 | Koldedin | 5/628 |
| 5,163,194 | 11/1992 | Dixon | 5/636 |
| 5,179,746 | 1/1993 | Rogers | 5/628 X |
| 5,224,226 | 7/1993 | Groenewald | 5/481 |
| 5,279,310 | 1/1994 | Hsien | 128/845 |
| 5,307,532 | 5/1994 | Connell | 5/643 |
| 5,435,323 | 7/1995 | Rudy | 5/628 |
| 5,819,746 | 10/1998 | Walton | 5/625 X |

FOREIGN PATENT DOCUMENTS

| | | | |
|---|---|---|---|
| 2163951A | 3/1986 | United Kingdom | 5/732 |

*Primary Examiner*—Michael F. Trettel

*Attorney, Agent, or Firm*—Garvey, Smith, Nehrbass & Doody, LLC

[57] ABSTRACT

A patient support apparatus which includes a firm body support portion constructed of foam, with the foam halving a first side for placement on a bed or gurney, and the second side upon which the body of the patient would be laid. The foam apparatus would include a principal upper torso support portion for supporting a patient generally from the top of the patient's head to the lower buttock region of the patient; first and second leg portions which are attachable to a lower edge of the principal body support portion for supporting the legs of the patient, and attachable arm portions secured to the side edges of the upper body support portion for accommodating the arms of the patient. The upper sides of the principal body portion, leg portions and arm portions would further include contoured regions which would reflect the general shape of the patient as the patient is laid on the patient's back on the apparatus, and would provide a soft yet firm support for the patient along the entire body region of the patient during transport. It is foreseen that in other embodiments, the apparatus may include a generally principal body support portion for supporting, for example, an infant in the support portion, which would support the entire length of the infant. Further, it is foreseen that the apparatus may be utilized in its separate components, depending on the extent of injury to the person being transported. Furthermore, other embodiments may include pockets formed within the principal body portion for inserting heating pads or other types of materials so that the patient may receive some form of treatment during transport or while the person is housed within an emergency medical facility awaiting treatment or is under specialized care.

10 Claims, 8 Drawing Sheets

PATIENT SUPPORT APPARATUS

CROSS-REFERENCE TO RELATED APPLICATIONS

This is a continuation-in-part application of U.S. patent application Ser. No. 08/779,927, filed Jan. 6, 1997, now U.S. Pat. No. 5,742,963, aincorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to supporting a patient in a prone position. More particularly, the present invention relates to a foam support apparatus which will support a patient along the entire body of the patient, or the upper torso or certain limbs of the patient, through a support system which includes removable contoured support components.

2. General Background of the Invention

In the art of patient care, one of the most difficult areas in caring for patients is the ability to make a patient comfortable and not at risk, particularly while the patient is being transported from the patient's home or the scene of an accident, to a hospital for managed care. In the present state of the art, patients who must receive emergency care and must require transport to a hospital or clinic in emergency response vehicles such as ambulances, fire teams, helicopters, or the like, are usually placed upon a gurney of some sort having a pad, such as a thin mattress, upon which the patient lies while the gurney is being carried by individuals and then later moved into the vehicle for transport. It is quite common that the ride between the scene of the accident or the patient's home to the medical facility is quite lengthy, often times requiring that the vehicles travel over very difficult roads, which may be very harmful, if not ultimately fatal to a patient in dire need. Often, it is the case that a patient who is in critical care and on life support, during transport, would require a much more stable and smooth ride to the medical facility in order to survive during this critical time.

Furthermore, even while the patient is resting at the hospital or medical care facility, it is required that the patient often times be supported on a very specialized type of bedding or the like, so that the patient's needs are met. Often times, such a type of support for the patient's body or upper torso or limbs is not available, and therefore the patient must suffer due to this lack of specialized bedding. Therefore, there is a need in the industry for addressing the transport of the critically ill or injured, particularly, in emergency response vehicles, in such a manner that the person who is injured or ill is supported in his most comfortable and secure setting, and that while he is in transport, that no further injury occurs to the patient because of the difficult ride. There have been patents cited in the art which attempt to address certain aspects of the problems which are confronted in the art, and these are incorporated into the prior art statement which is being filed simultaneously herewith.

BRIEF SUMMARY OF THE INVENTION

The apparatus of the present invention solves the problems in the art in a simple and straightforward manner. What is provided is a patient support apparatus which includes a firm body support portion constructed of foam, with the foam having a first side for placement on a bed or gurney, and the second side upon which the body of the patient would be laid. The foam apparatus would include a principal upper torso support portion for supporting a patient generally from the top of the patient's head to the lower buttock region of the patient; first and second leg portions which are attachable to a lower edge of the principal body support portion for supporting the legs of the patient, and attachable arm portions secured to the side edges of the upper body support portion for accommodating the arms of the patient. The upper sides of the principal body portion, leg portions and arm portions would further include contoured regions which would reflect the general shape of the patient as the patient is laid on the patient's back on the apparatus, and would provide a soft yet firm support for the patient along the entire body region of the patient during transport. It is foreseen that in other embodiments, the apparatus may include a generally principal body support portion for supporting, for example, an infant in the support portion, which would support the entire length of the infant.

Further, it is foreseen that the apparatus may be utilized in its separate components, depending on the extent of injury to the person being transported. Furthermore, other embodiments may include pockets formed within the principal body portion for inserting heating pads, gel packs, or other types of materials so that the patient may receive some form of treatment during transport or while the person is housed within an emergency medical facility awaiting treatment or is under specialized care.

Therefore, it is the principal object of the present invention to provide a foam patient support apparatus which would support the entire body portion of the patient, while the patient is being transported or in emergency care;

It is a further object of the present invention to provide a foam patient support apparatus which is able to be assembled into individual components and when fully assembled, define support for the entire body yet when disassembled in certain formations, provide for support for only certain parts of the body as the case may be;

It is the further object of the present invention to provide a foam patient support apparatus which is sufficiently durable to allow abuse of the apparatus by certain patients, yet sufficiently soft to prevent bed sores or the like from forming;

It is a further object of the present invention to provide a body support apparatus which is custom cut along an upper surface for contouring, in general, to the contours of a patient's body so that the patient has sufficient comfort and support during transport in emergency vehicle;

It is a further object of the present invention to provide a patient body support apparatus which has removable leg and arm portions which can simply be attached or detached from the principal body support portion, depending on the need;

It is a further object of the present invention to provide a patient body support apparatus which includes pockets or the like within the apparatus for inserting other types of units such as heating pads, gel packs, or certain types of bladders which would allow further care to the patient as the case may be;

It is a further object of the present invention to provide a lightweight yet firm and soft support apparatus for a patient which is relatively inexpensive, and can be transported quite easily within an emergency vehicle in an unassembled state and when assembled, provides significant support for the patient being transported in the vehicle;

It is a further object of the present invention to provide a support apparatus for a patient which is mountable on a vinyl board, the apparatus further comprising an under-support portion capable of defining a rigid support base in the event a spinal board is unavailable;

It is a further object of the present invention to provide a support apparatus for a patient which is mountable on a spinal board, which would prevent primary and secondary spinal injuries to a patient who would be transported on a spinal board without the apparatus thereupon.

BRIEF DESCRIPTION OF THE SEVERAL VIEW OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 7:
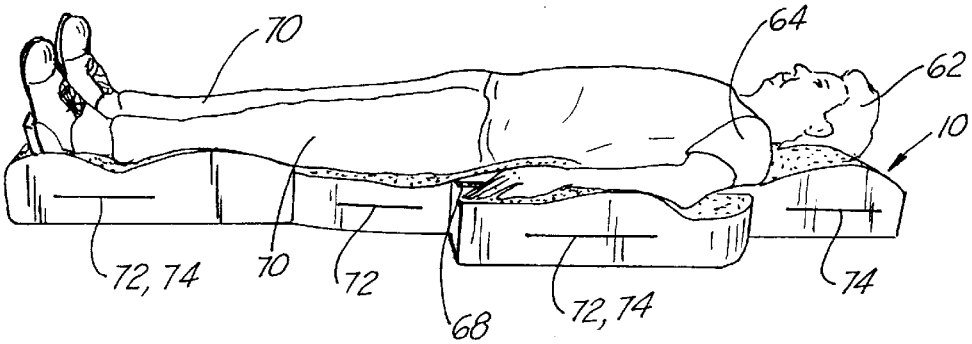
FIG. 7 is a side view thereof.
Figure 8:
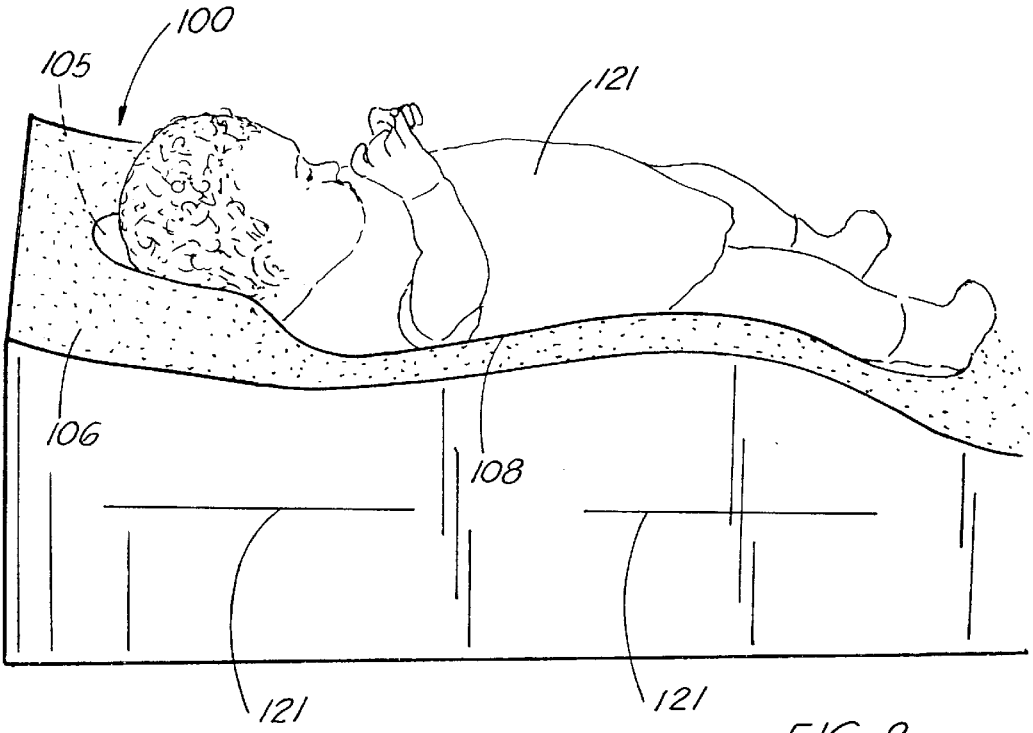
FIGS. 8 and 9 are side and front views of an additional embodiment of the apparatus of the present invention, with an infant supported therein.
Figure 9:
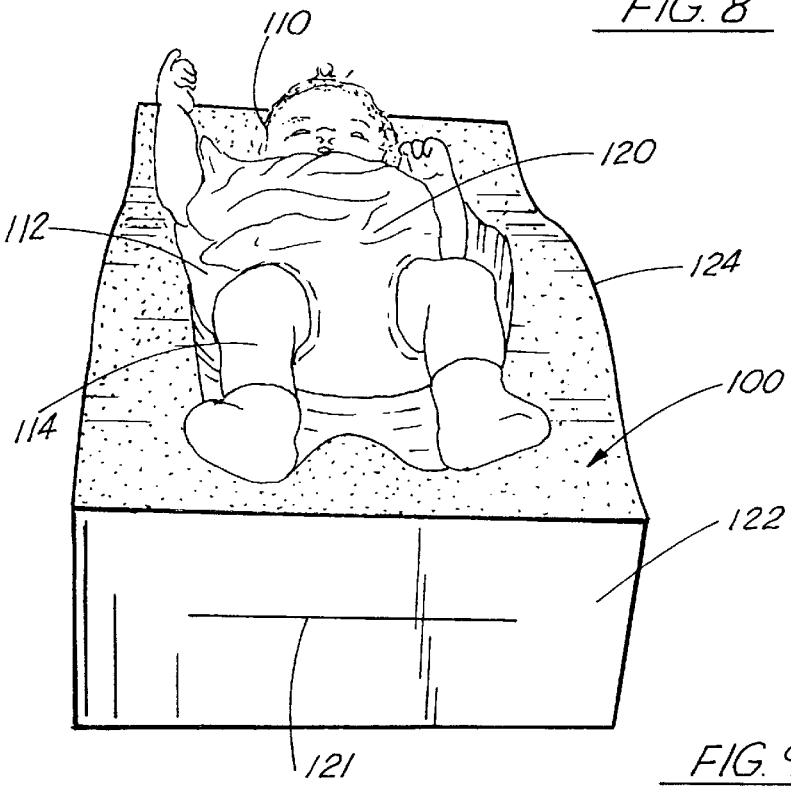
Figure 10:
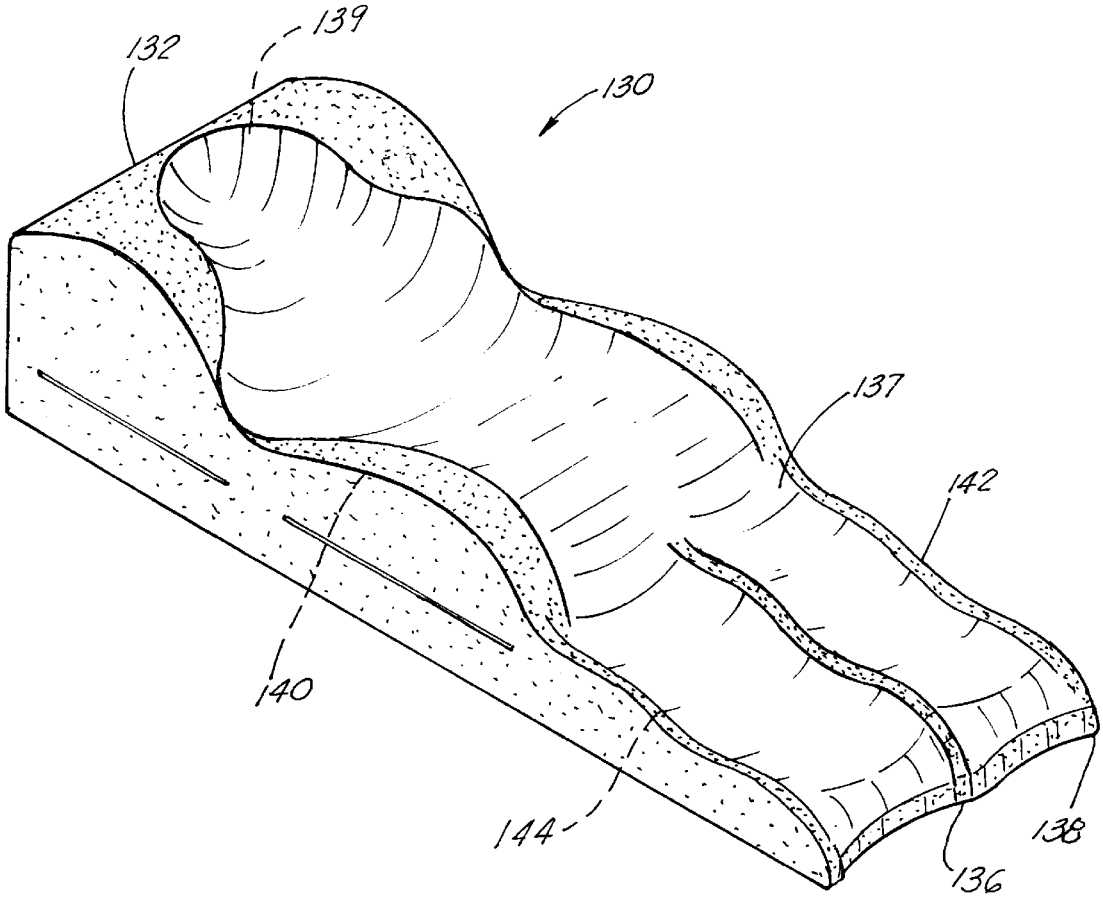
FIG. 10 illustrates an additional embodiment of the apparatus of the present invention.

FIGS. 1–8 illustrate the preferred embodiment of the apparatus of the present invention by the numeral 10, with FIGS. 9 and 10 illustrating an alternative embodiment of the present invention.

Figure 2:
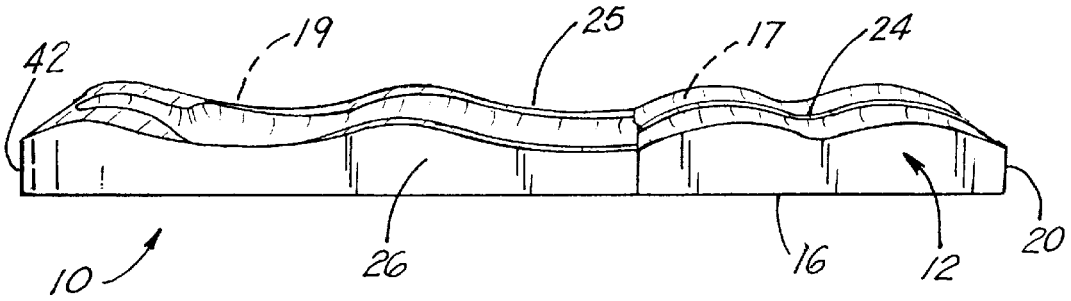
FIG. 2 is an overall side view of the preferred embodiment of the apparatus of the present invention.
Figure 1:
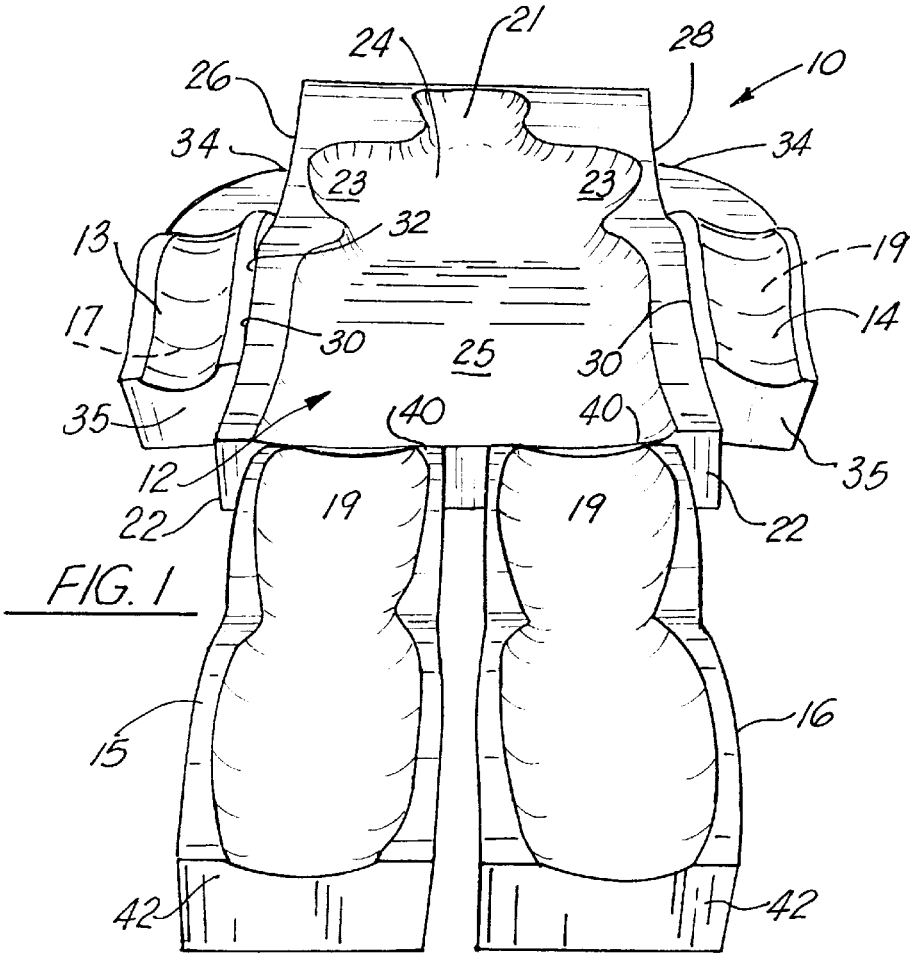
FIG. 1 is an overall view of the preferred embodiment of the apparatus of the present invention.

Turning now to FIGS. 1 and 2, the preferred embodiment of the present invention is labeled as apparatus 10. Apparatus 10 includes a principal body portion 12, arm portions 13, 14, and leg portions 15, 16. As illustrated in FIG. 1, all of the components, namely the body portion, leg portions and arm portions, of the preferred embodiment are constructed of a hard, firm yet soft supporting foam material, which is generally known in the art, and would allow in general a support for a patient lying thereupon, yet would allow support with comfort. As illustrated, the principal body portion 12 as seen in FIG. 1 and in side view in FIG. 2 includes a lower face 17, which is generally flat and would lie upon a hard flat surface 18 such as a stretcher in an ambulance or the like. As is illustrated, the body portion would further include a forward edge 20 and would terminate in a lower edge 22. The body portion would be substantially two to four inches in thickness along its entire length, with the length of the body portion 12 extending from first edge 20 just above the head portion of a patient to the lower edge 22 which would terminate generally at the lower portion of the buttocks of the patient. When a patient is laid upon the upper surface 24 of body portion 12, the patient would be supported from the top of his head to the lower portion of the buttocks on the principal body portion 12.

Further, as seen in FIGS. 1 and 2, as was stated earlier, there are illustrated arm portions 13, 14. Each of the arm portions 13, 14, would extend generally from the upper side walls 26, 28 of the body portion 12 and would include an inner edge 30 which would lie along the sidewalls 26, 28 of body portion 12, terminating at ends 35. For purposes of construction as seen more clearly in FIG. 2, there may be included a layer of a loop and hook fabric attachment system known under the registered trademark as Velcro 32 along the entire edge 30 of arm portions 13, 14, so that when arm portions are placed in the position as seen in FIG. 2, the arm portions remain stabilized by the VELCRO 32 along edges 30 and sidewalls 26, 28, of body portion 12. Therefore, there is no movement of arm portions 13, 14, which may endanger the health and safety of a patient lying thereupon. Further, each of the arm portions 13 and 14 are secured at their upper most points 34 to the body portion 12 with an inner locking mechanism, which cannot be seen in FIGS. 1 and 2, but will be discussed further, as reference is made to additional FIGURES.

Turning now to the leg portions as is illustrated in FIGS. 1 and 2, leg portions 15, 16 again have an upper edge 40, which meet the lower edge 22 of the body portion 12 and are secured thereto. Like the arm portions, the upper edge 40 of the leg portions 15, 16 are engaged with a locking feature which is shown in phantom view in FIG. 1, but again will be discussed more fully. The leg portions would simply extend downward along their entire length and would terminate at lower ends 42 so that when secured to the lower edge 22 of body portion 12, there would be defined an entire length of support for supporting the length of an average sized patient or the like. Also, as was described with arm portions 13, 14, each of the leg portions 15, 16 are secured along their upper edge 40 to the lower edge 22 of body portion 12 with VELCRO so that even though locked in place by the locking feature, the legs would also be connected to body portion 12.

Figure 3:
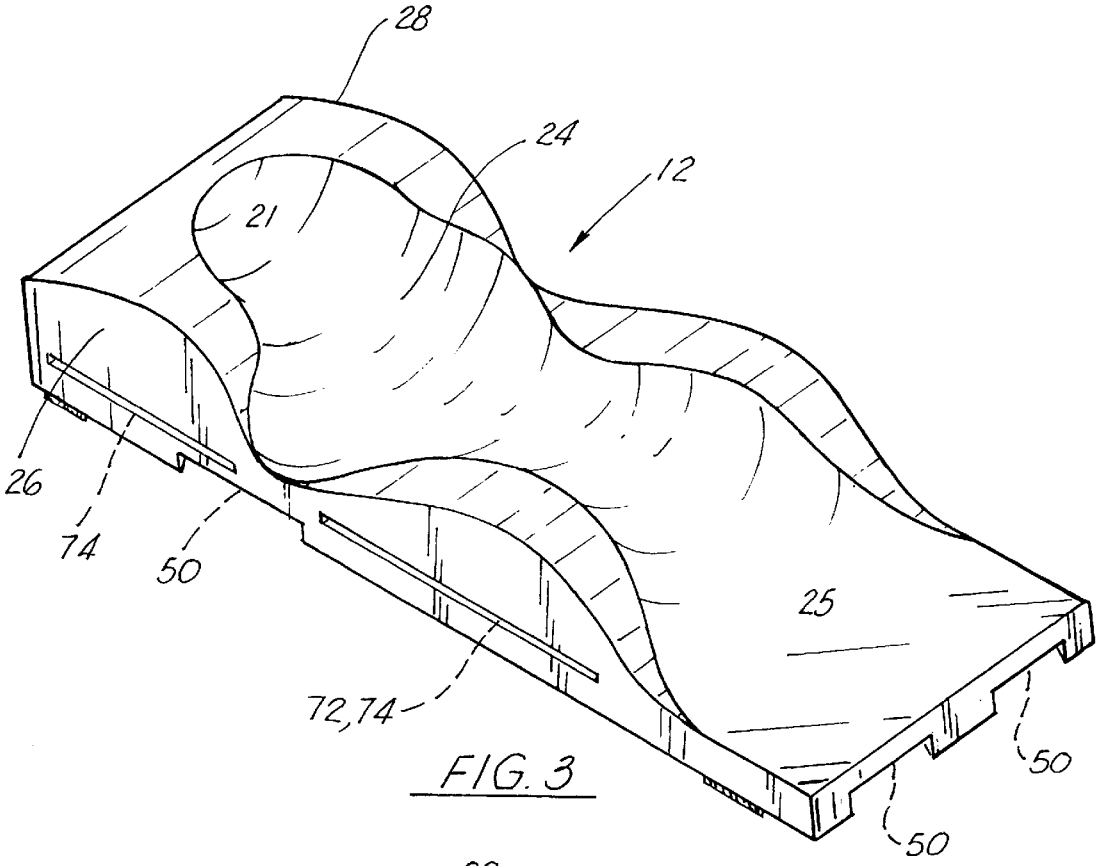
FIG. 3 is a partial side view of the torso portion of the apparatus of the present invention, illustrating the contours of the apparatus for a patient to be transported thereupon.

Turning now to a significant feature of the apparatus, again making reference to FIGS. 1, 2, and 3 is the fact that the apparatus although having a flat lower face 17 as seen in FIG. 2 for being supported upon a surface 18 or the like, the upper face 24 of the body portion 12 has formed therein a contour means which is a recessed area which defines first a recessed head area 21, a shoulder area 22 recessed into the thickness of the foam material, and generally a center lumbar region 25 in the body portion. Likewise, each of the arms 13, 14 include a recessed area 17 along their length for defining the arms which would be set therein. Likewise, each of the leg portions 15, 16 would include a recessed area 19 which again would define an elongated recessed portion in which the thigh and calf portion of the legs of a patient would rest. As seen clearly in FIGS. 1 and 2, these recessed areas as explained earlier, would serve to fit the contour in general of an average patient and yet would allow the patient's upper torso arms and legs and head to be supported therein so that in comfort yet with minimal movement since the appendages in the body are resting in a recessed, contoured area.

Figure 4A:
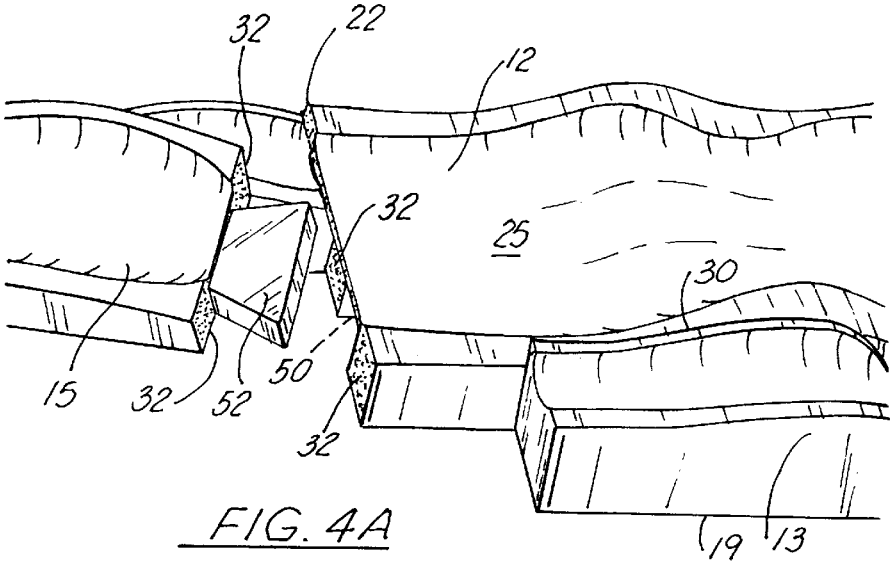
FIGS. 4A and 4B illustrate partial views of the preferred embodiment of the apparatus of the present invention, illustrating the attachment of a leg component thereupon.

FIGS. 4 and 5 illustrate the means by which the leg portions 15, 16, and the arm portions 13, 14, are secured in place to the body portion 12. For example, in FIG. 4A, there is illustrated body portion 12 which again terminates in lower edge 22. As illustrated, the lower edge 22 would include a pair of openings 50 along the lower edge 22, each of the openings 50 which would be dovetail shaped, in order to receive a dovetail portion 52 formed on the upper edge 40 of each of the leg portions 15, 16. As illustrated in FIG. 4, the portion 52 extending from the upper edge 40 would fit into openings 50, and would be locked in place due to its dovetail shape, and once set in place as seen in FIG. 1, would be difficult to remove by a patient yet would be easily removed by a person working in the emergency room.

Figure 5A:
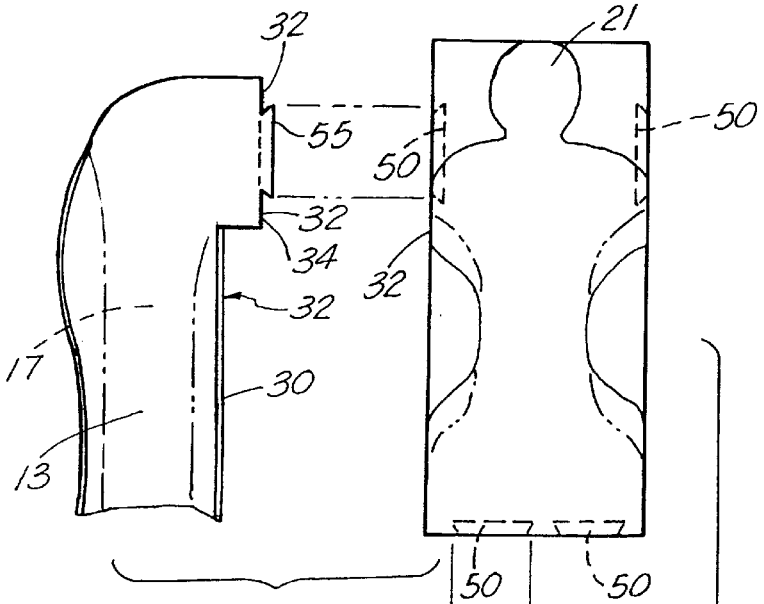
FIGS. 5A and 5B illustrate partial views of the preferred embodiment of the apparatus of the present invention illustrating the attachment of arm and leg components thereon.

Likewise, as seen in FIG. 5A, the body portion further includes a pair of openings 50, one on each side wall 26, 28 of body portion 12, again each of the openings 50 formed in a dovetail shape for receiving a dovetail portion 55 which would be extending from each of the arm portions 13, 14. As illustrated in FIG. 5, the dovetail portion 55 would be forced into opening 50 and once in place, because of its dovetail shape, could not easily be removed by the movement of the patient but like with the leg portions, could easily be removed by a worker in the emergency room or in the emergency vehicle.

Figure 5B:
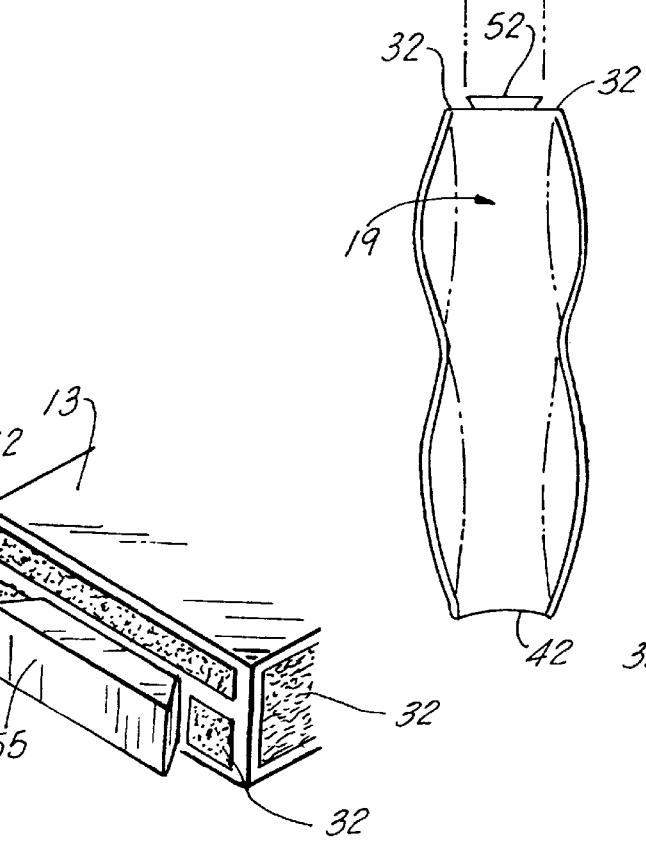
Figure 4B:
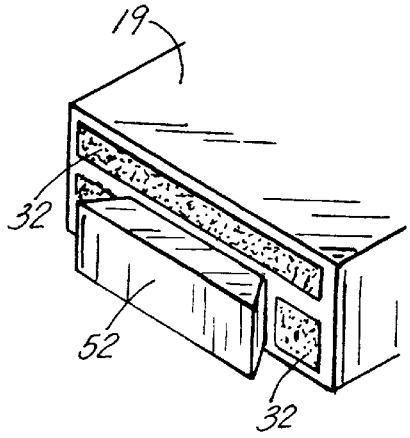

Further, as stated earlier, as illustrated in FIGS. 4B and 5B, in order to further accommodate the positioning of the leg portions 15, 16 and arm portions 13, 14 in place against the body portion 12, there is included a layer of VELCRO 32, for example, along the upper edge 40 of each of the leg portions 15, 16, which when the leg portion is in place as seen in FIG. 1, the VELCRO would be secured to a second piece along the lower edge 22 of body portion 12 so that in addition to the dovetail interlocking as was described earlier, there would be attaching of the leg portion 15, 16 to the body portion 12. This can be seen clearly in FIG. 4B. Also, reference is made to FIG. 5B, wherein in addition to the dovetail portion 55, being secured within openings 50, each of the arm portions along their inner edge 30 would include a strip of VELCRO 32 extending generally from the upper shoulder region 34 to the lower end 35 of each of the arm members so that when the arm member is set in place as seen in FIG. 1, the length of Velcro between edges 30, and sidewalls 26, 28 would hold the arm members in place as seen in FIG. 1, so that any slight movement by the patient would be retarded yet the arm members could easily be removed from their position by a worker in the medical unit.

Figure 6:
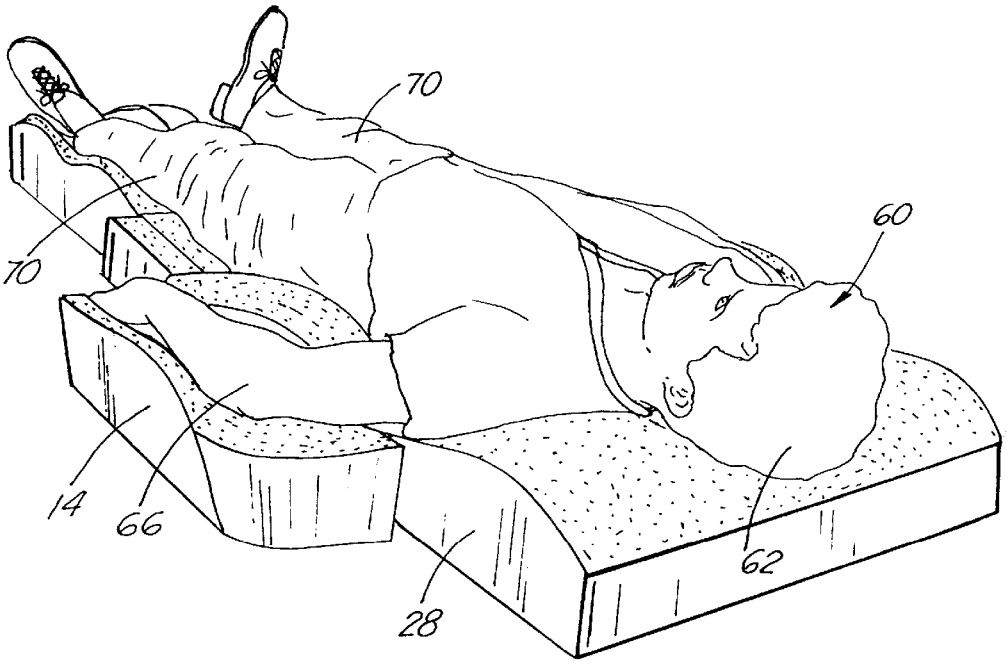
FIG. 6 is an overall view of the preferred embodiment of the apparatus supporting a patient thereupon.

The FIGS. 6 and 7 are included herewith to clearly illustrate the functioning of the apparatus when there is a patient lying thereupon. As seen in FIGS. 6 and 7, a patient 60 is laying prone on his back upon apparatus 1 of the type as seen in FIG. 1. As is noted, the head 62 of the patient rests easily within the recessed area 21 of the principal body portion, with the shoulders 64 of the patient resting in the contoured area 23 of the body portion 12. Likewise, each of the patient's arms 66 are laying at his side with the arms generally resting within the contour area 17 of each of the arm members 13, 14. Further, following down the patient's lower lumbar region 68 is resting within the recessed area 25 of the principal body portion 12, and each of the patient's legs 70 are resting within the contours 19 of the leg portions including the upper thigh and lower calve portion of the patient. In this position, it is noted, particularly in FIG. 7, because of the thickness of the apparatus 10 of the firm foam, the patient is firmly secured yet is resting comfortably.

For purposes of clarification, as seen in FIG. 7, there are openings 72 and 74 formed within the side edge 32 of the body portion 12. This particular feature is noted because the body portion 12 would incorporate pockets of sorts so that heating pads, gel packs or other types of treatment could be inserted into these pockets and provide additional types of relief to a patient lying thereupon. Such pockets 72, 74 could also be included on each of the arm portions 13, 14 and likewise each of the leg portions 15, 16. Furthermore, as illustrated in side view in FIG. 7, there may be included an inflatable pillow which could be incorporated into the head region 21 of the principal body support portion 12, so that when inflated would tend to lift the head of the patient. Furthermore, there could be an inflatable head portion which when inflated could provide an inflatable support at each side of the patient's head for maintaining the patient's head in a relatively straight forward position and would not allow the patient's head to turn back and forth, should there by any potential neck injury or the like which is being addressed, either during transport or initial resting of the patient therein.

In the preferred embodiment, it is foreseen that the apparatus would be useful in many settings. For example, because of the lightweight material and the fact that the apparatus is assemblable into a principal body portion, leg portions, and arm portions, it could be easily stored away, for example, in en emergency transport vehicle, and easily assembled on site should the case call for it. Furthermore, because of the fact that the apparatus is constructed of one-piece foam for the body portion, it is foreseen that it would be very durable and able to withstand much transport and even abuse by a patient. The assembling of the apparatus as noted earlier is quite simple, and therefore would be easy to assemble and disassemble on very short notice.

Reference is now made to FIGS. 8 and 9 which illustrate an additional embodiment of the apparatus of the present invention. The only difference between this embodiment and the principal embodiment is the fact that this modified apparatus labeled as 100 illustrates a support apparatus which is in a single piece, and is particularly suitable for a small child or infant. Because of the very short length of a child or infant's body, one could foresee that a single piece of foam 102, could be formed having a lower surface 104 for resting on a bed or the like, and an upper surface 106 which would have a contour 108 formed along its upper surface 106, the contour which would generally be shaped like a baby's body, that is having a head portion 110, a generally upper torso portion 112, and a pair of leg portions 114, so that an infant or baby 120 could be laid within the contoured area and would be maintained flat on its back during transport, yet would be restricted in its movement and would be relatively comfortable and ultimately safe while being transported. Again, like with the principal embodiment, the body portion may include a series of pockets 121 along its lower edge 122 or its side edges 124 so that other types of treatment such as heating pads or gel packs could be placed therein for providing further treatment to an infant supported in the apparatus 100.

FIG. 10 illustrates yet an additional embodiment of the invention. As illustrated, the embodiment illustrates an apparatus 130, which extends from an upper edge 132, at the head portion, to the lower end 136, which would terminate at point 138, which would be at the knee of the average person, defining the body portion 137. The apparatus 130 would have the same contours as the preferred embodiment, with a contoured head area 139, extending into a contoured torso area 140, and terminating in a pair of contoured thigh areas 142, 144. The principal difference in this embodiment is the fact that there is no lower leg portions, no arm portions, and the width of the body portion 137 would be sufficiently narrow to fit upon an ambulance gurney, for transporting a patient on such a narrow surface, but, secured firmly within the contoured apparatus 130. For purposes of further securement, the contoured head portion 139 may be slightly deeper, so that the head of the patient is encased within the contour to reduce unwanted movement.

Figure 11:
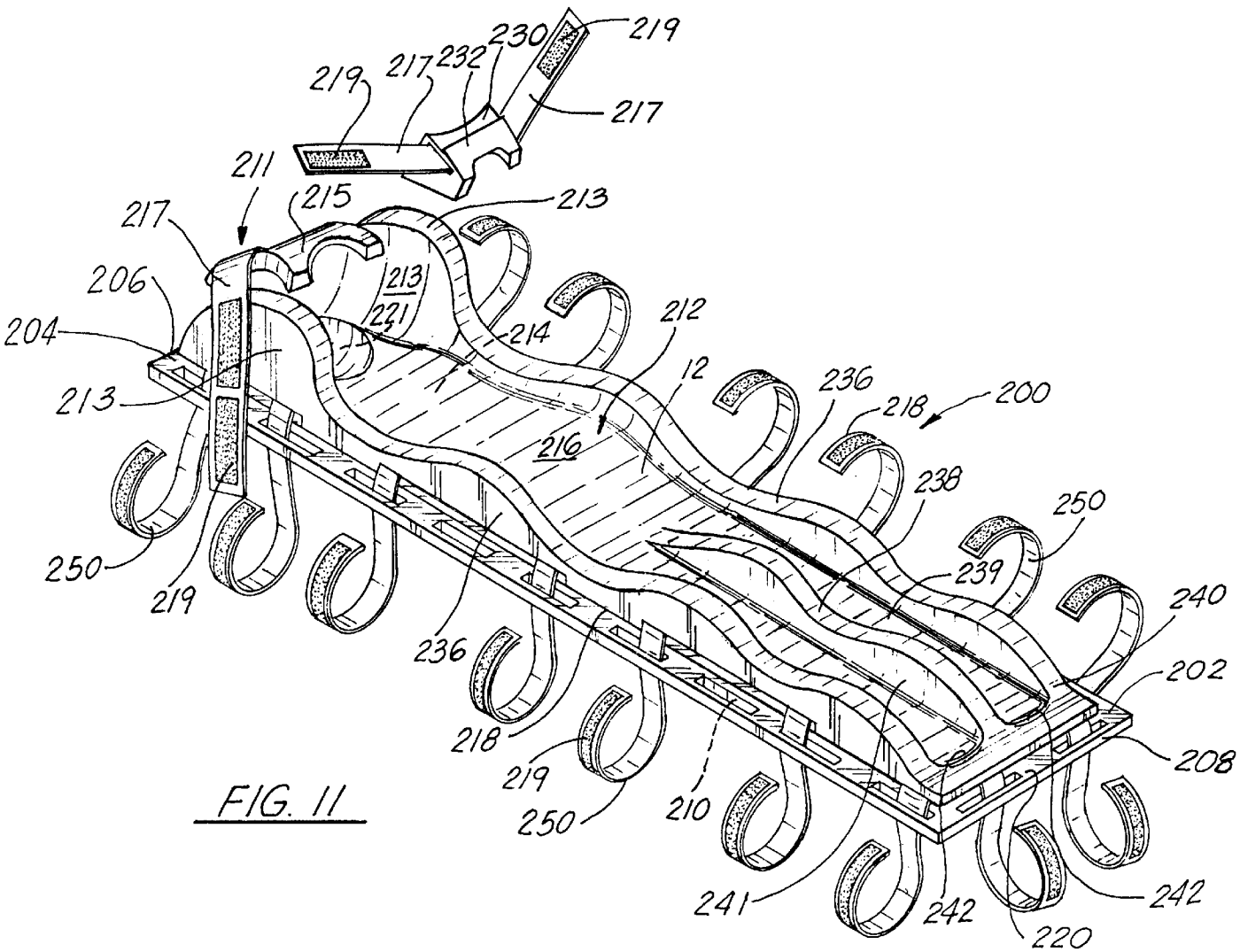
FIG. 11 illustrates an overall view of the improved preferred embodiment of the apparatus of the present.
Figure 12:
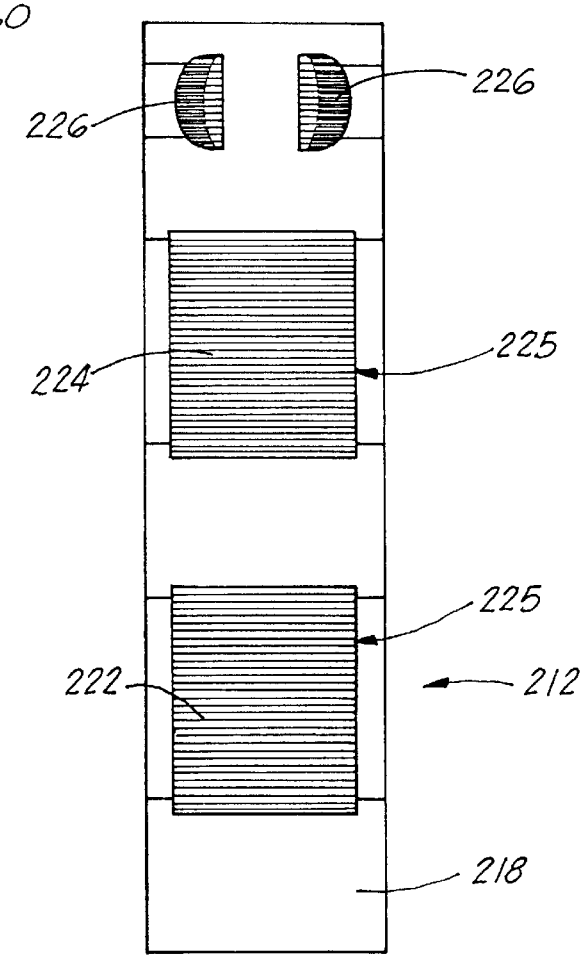
FIG. 12 illustrates an underside view of the improved preferred embodiment of the apparatus of the present invention.
Figure 13:
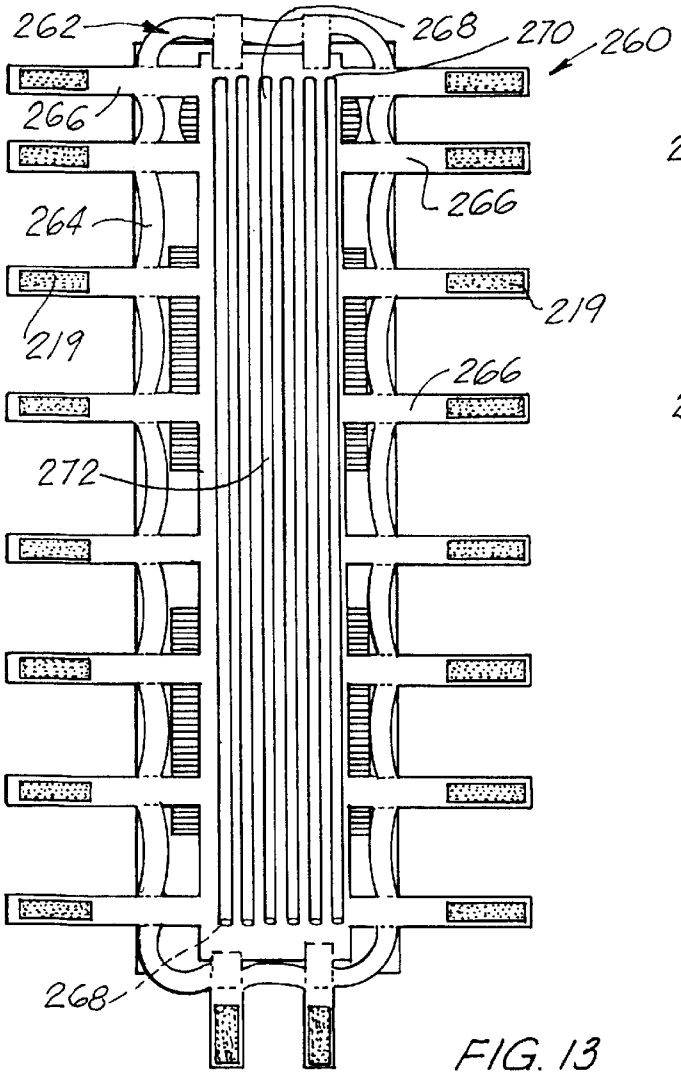
FIG. 13 illustrates an additional feature securable to the improved preferred embodiment of the apparatus of the present invention when a spinal board is unavailable.

FIGS. 11–13 illustrate an improved version of the preferred embodiment of the present invention by the numeral 200. As illustrated first in FIG. 11, there is illustrated a standard spinal board 202 of the type known in the industry having a sufficiently flat surface 204, a first end 206, a second end 208 with a plurality of openings 210 along the boarder of the spinal board 202 so that it may be carried or that straps or the like may be threaded therethrough. As illustrated in FIG. 11, the spinal board 202 has positioned thereupon the improved apparatus 200 of the present invention which includes a body portion 212 molded so as to conform substantially to the length and the width of a standard spinal board 202, with molded body portion 212 comprised of a closed cell urethane material, which is known in the art, and which would include a coating 213 which would cover the entire apparatus 200, and particularly along its interior area 214 so that a patient laying in the contoured area would not stick to the surface 216 of the body portion 212 and the coating 213 would help to reduce the "sweating factor" of the patient laying thereupon. The process for coating such material is commonly known in the art and is a feature which is currently being utilized in the mattress industry. As further illustrated, the body portion 212 includes a lower surface 218 which is substantially flat, and would rest on the upper surface 220 of the standard spinal board 202 as illustrated in FIG. 11.

Reference however, is made to FIG. 12 where the flat under surface 218 of the body portion 212 is illustrated which, for the most part, comprises a flat surface which makes contact with the upper surface 220 of the spinal board. However, there is illustrated a pair of rectangular areas 222, 224, which are positioned along substantially the upper torso region of the patient and the leg region of a patient so as to define contoured pocket areas 225 for placement of air cushions in order to provide more comfort for a patient resting on the apparatus as it is being moved on a spinal board 202. Further, there is illustrated a pair of crescent shaped pocket areas 226 which are positioned again on the under side 218 of the body portion 212 with the crescent shaped pocket areas 226 offering again means for air cushions for supporting the neck and head region of the patient laying thereupon.

Returning now to FIG. 11, it should be noted that the body portion 210 includes an upper head region 212 which includes a raised head restraint areas 213 on either side of the patient's head, with an upper padded head restraint 215 having a nylon strap 217 with VELCRO 219 so that the patient's head may be placed within the recessed head region 221 on the surface 216, and once in place, the upper portion 215 may be pressed against the upper portion of the patient's head with the nylon stray 217 securing it in place. Further, there is a chin and neck restraint member 230 which is illustrated in FIG. 11, which also has a pair of nylon straps 217 and a body portion 232, so that as the patient is resting on the apparatus with the patient's in recess 221, the chin and neck restraint member 230 can be placed on the patient and may be secured in place with straps 217 and VELCRO 219. It should be noted that like the body portion 212, the chin and neck restraint member 230 would likewise comprise of the closed cell urethane and with the same type of coating to prevent sticking to the patient as it is mounted thereupon.

A further improvement of the apparatus 210 of the present invention is the fact that there is a continuous side wall 236 which extends along both sides of the body portion 212, with the side wall 236 substantially maintaining the patient within the patient area 213 of the body portion 212. It is noted that there is an additional raised wail 238 which runs substantially along the lower central portion of the apparatus which would serve to divide the lower region of the apparatus into its first and second leg spaces 239 and 241. As part of the improvement, the wall portion 236 and leg divider, 238 have been reduced in height so that while maintaining the patient secured within the apparatus 200, they are not raised to such a height that it becomes difficult for the patient to roll over from a bed into the apparatus 200. The lower wall portions help to reduce the effort that must be made in order to get the patient into the apparatus. It should be noted further that at the lower ends 240 of the leg portions 239, 241, there is illustrated heel restraint recesses 242 which eliminate the stress on the muscles and tendons in the calves as the patient was laying in the apparatus 200 for greater comfort.

As is further illustrated, after the apparatus 200 has been placed upon the spinal board 202, there is seen a plurality of nylon straps 250 which are spaced along the outer wall of the apparatus, with the plurality of straps being threaded through each of the openings 210 in the spinal board 202. The nylon straps 250, also have a patch of VELCRO 219 upon each strap, so that each strap may be folded along the undersurface of the spinal board 202 and connectedly engaged to the opposing strap 250 on the second side of the apparatus so as to maintain the body portion 212 placed securely on the spinal board during transport.

An additional feature which is crucial to the use of the apparatus is illustrated in FIG. 13. In FIG. 13 there is seen an underside view of an under-support apparatus 260 which comprises a continuous nylon strap member 262 having a continuous border component 264 which defines substantially the under-support apparatus 260, which is of substantially of the width and length of the apparatus 200 as illustrated in FIG. 12. The continuous rectangular strap member 260 would include a plurality of restraining straps 266 again spaced along its length, which each of the straps 266 having a patch of VELCRO 219 on its end, so that when a patient is placed upon the body support member 210, the straps 266 may be engaged around the patient and hold the patient in place. One important feature of this under support system is the fact that there is included a plurality of pockets 268 along the length of the central body portion 270 of apparatus 260 so that a plurality of substantially solid nylon rods 271 may be slipped within the pockets 268 and define secure under-support wall 272 when the patient is placed on the apparatus. Therefore, when the spinal board is not available, by placing the plurality of nylon rods 271 in place into pocket 268, the relatively flexible body support portion 212 has a rigid under-support wall 272 so that the patient may be carried in the same manner that a patient would be carried with a spinal board in place.

The foregoing embodiments are presented by way of example only; the scope of the present invention is to be limited only by the following claims.

What is claimed is:

1. A patient support apparatus, formed of foam material, comprising:

a. a principal body portion having a lower face for resting on a generally flat surface, and an upper face for supporting a patient lying thereupon;

b. contoured regions formed in the principal body portion which generally conform to the shape of a person, for supporting the patient comfortably, yet securely on the support apparatus;

c. a head support portion, further comprising a cover positionable against the upper portion of the patient's head and secured to the body portion for maintaining the patient's head immovable during transport; and d. openings formed in the underside of the body portion for allowing air cushions to be placed therein for additional comfort of the patient.

2. The apparatus in claim 1, further comprising an upright wall portion provided around the perimeter of the body portion, for maintaining the patient within the contoured regions of the body portion, yet low enough to move the patient onto and off of the body portion.

3. The apparatus in claim 1, further comprising a plurality of straps along an edge of the body portion for securing the body portion onto a spinal board.

4. The apparatus in claim 1, wherein the body portion further includes a chin support portion contoured to secure the chin of the patient as the head is secured by the head cover portion.

5. A patient support apparatus, to support a patient in the prone position, comprising:

a. a principal body portion having a lower face for resting on a generally flat surface, such as a spinal board, and an upper face having contoured areas for supporting a patient lying thereupon;

b. openings formed in the underside of the body portion for allowing air cushions to be placed therein for additional comfort of the patient;

c. an under-support surface, substantially the same dimensions as the principal body portion, and further comprising a plurality of pockets to receive a plurality of rigid rods for defining a support area for the patient, when a spinal board is unavailable; and d. a plurality of straps for engaging the principal body portion and the under-support surface together as a single functioning unit.

6. The apparatus in claim 5, further comprising a upright wall portion provided around the perimeter of the body portion, for maintaining the patient within the contoured regions of the body portion, yet low enough to move the patient onto and off of the body portion.

7. The apparatus in claim 5, further comprising a head support portion, further comprising a cover positionable against the upper portion of the patient's head and secured to the body portion for maintaining the patient's head immovable during transport.

8. The apparatus in claim 7, wherein the body portion further includes a chin support portion contoured to secure the chin of the patient as the head is secured by the head cover portion.

9. The apparatus in claim 5, wherein the body portion is constructed of firm, soft foam material.

10. A patient support apparatus, formed of foam material, comprising:

a. a principal body portion having a lower face for resting on a generally flat surface, and an upper face for supporting the upper torso of a patient lying thereupon;

b. contoured regions formed in the principal body portion which generally conform to the shape of a person, for supporting the patient comfortably, yet securely on the support apparatus;

c. a head support portion, further comprising a cover positionable against the upper portion of the patient's head and secured to the body portion for maintaining the patient's head immovable during transport;

d. at least one opening formed in the underside of the body portion for allowing air cushions to be placed therein for additional comfort of the patient.

* * * * *